United States Patent [19]

Kitajima et al.

[11] Patent Number: 4,854,571

[45] Date of Patent: Aug. 8, 1989

[54] SHEET SORTING DEVICE

[75] Inventors: Tadayuki Kitajima, Yokahama; Toshiyuki Asakawa, Sagamihara; Masataka Naito, Yokohama; Kazuhiro Matsuo; Toshiaki Murayama, both of Tokyo, all of Japan

[73] Assignee: Canon Kabushiki Kaisha, Tokyo, Japan

[21] Appl. No.: 838,826

[22] Filed: Mar. 12, 1986

[51] Int. Cl.[4] ..... B65H 39/10

[52] U.S. Cl. ..... 271/293; 271/294

[58] Field of Search ..... 271/293, 292, 294

[56] References Cited

U.S. PATENT DOCUMENTS

| | | | |
|---|---|---|---|
| 3,788,640 | 1/1974 | Stemmle | 271/293 |
| 4,343,463 | 8/1982 | Lawrence | 271/293 |

FOREIGN PATENT DOCUMENTS

| | | | |
|---|---|---|---|
| 57-66863 | 10/1983 | Japan . | |
| 57-76915 | 11/1983 | Japan . | |
| 193858 | 11/1983 | Japan | 271/293 |
| 158762 | 9/1984 | Japan | 271/293 |
| 112568 | 6/1985 | Japan | 271/293 |
| 228357 | 11/1985 | Japan | 271/293 |

*Primary Examiner*—H. Grant Skaggs

*Attorney, Agent, or Firm*—Fitzpatrick, Cella, Harper & Scinto

[57] ABSTRACT

A sheet sorting device having a plurality of bin trays has a resilient member for imparting to a bin tray support member a force in the direction opposite to the direction of gravity and reducing a load applied to a bin tray drive source. A detecting device for stopping the driving of the drive source detects the movement of the drive source when the drive source moves up or down relative to the bin trays. A cam member has two lead portions, smooths the movement of the bin group and makes the amount of opening between the bins always constant.

12 Claims, 11 Drawing Sheets

SHEET SORTING DEVICE

BACKGROUND OF THE INVENTION

1. Field of the Invention

This invention relates to a sheet sorting device (hereinafter referred to as the sorter) used for distribution, accumulation, etc. of sheet-like members (hereinafter simply referred to as sheets) carried out from a machine such as a copying machine, a printing machine, a recording machine or other machine (hereinafter referred to as an image forming apparatus) provided with a mechanism for conveying sheet-like members (including various sheet-like members such as copy sheets, printing sheets and recording sheets).

2. Description of the Related Art

The device of this type (the details of which are described in Japanese Patent Application Laid-Open No. 78770/1981) has heretofore been of a construction as shown in FIG. 1 of the accompanying drawings wherein the rear ends 1 of bins 2 are held and only the fore ends of the bins are successively moved upwardly or downwardly by the engagement between engaging members 3 at the fore ends of the bins 2 and a Geneva stop 4 or a spiral cam comprising a single groove. In such a construction, if the angle of inclination of the bins with respect to the direction of sheet conveyance is $\alpha$, the angle $\alpha$ differs from bin to bin, and this has led to a disadvantage that the sheet supporting property differs between the bins.

As a method of the eliminating this disadvantage (that is, making the angle of inclination $\alpha$ of the bins constant), there is a method of vertically moving the bins as a unit and enlarging the spacing between the bins at the sheet carry-out port while successively moving the bins from one side to the other side. For example, as shown in FIG. 2 of the accompanying drawings, the spacing of engaging members 6*a*, 6*b*, provided on the bin 6, in the direction of movement (the spacing between 6*a*–9*a* and between 6*b*–9*b*) is controlled by support frame members 12 and 15, and an engaging member (not shown) provided on the rear end of the bin is also held by the support frame member 12 and therefore, a spiral cam comprising a spiral groove engages the engaging members (e.g. 6*a*, 6*b*) at the fore end of the bin, whereby the support frame member 12 itself is moved up and down and thus, the bin group is moved up and down as a unit. In such construction, the aforementioned disadvantage of the non-uniform supporting property of the bins is eliminated, but in the case of a high-speed sorter, when the bin tray group is to be moved upwardly or downwardly, a difficulty is caused when moving the bin tray group of heavy weight intermittently and rapidly, for example, the mechanical abrasion or damage by vibration, noise, shock, etc. Considering, for example, a case where all bins are being moved up in FIG. 2, the engaging members 9*a* and 9*b* of the bin 9 support all the load of the bin group, and the load of the bin group shifts to the engaging members 8*a* and 8*b* of the bins 8 when the bin 9 moves downwardly. Such shift of all the load takes place intermittently, whereby great noise or vibration occurs and expedites the mechanical abrasion, which in turn shortens the life of the device.

Further, as a method for eliminating such a disadvantage, there is known a method of dividing moving means for the bin group and means for enlarging the spacing between the bins at the sheet carry-out port and making them discrete from each other. For example, as shown in FIG. 3 of the accompanying drawings, a pin 21 for supporting the load of the bin group is provided on a bin frame 20 and this pin 21 is brought into engagement with a lead cam shaft 22 having the shape of a spiral groove to thereby effect continuous upward and downward movement of the bin group as a unit. Also, at the sheet carry-out port, for example, a bin 23, is moved to a position 23, by a spiral cam 24 comprising a groove to thereby enlarge the spacing between the bin $\mathbf{23}_1$ and $\mathbf{23}_2$. With such construction, the aforementioned disadvantage of the non-uniform sheet supporting property of the bins and the noise can be eliminated. However, again in this construction, the presence of the lead cam shaft 22 and the engaging pin 21 and the difference in shape between the grooves of the spiral cam 24 and the lead cam shaft cause a phase difference in the direction of height and therefore, a mechanism for alleviating this is necessary and moreover, two large extra lead cam shafts 22 become necessary, thus making the mechanism complicated and bulky, and also there are four locations of engagement with the lead cam shafts, which means a disadvantage that the assemblage and serviceability of the device are remarkably hampered.

Also, in a movable bin type bin shifting device, a chain or wire has been fixed to the ends of a bin unit comprising a plurality of bins and a bin support plate for supporting the bins and the chain or wire has been moved by a discrete driving device to move the bin unit up or down. As another method, a pin fixed to the ends of the bin unit has been operatively associated with a rotatable lead screw and the lead screw has been rotatably controlled to thereby moved the bin unit or down. Thus, in the former example, a brake device for moving the bin unit up or down to a predetermined place and fixing it at the predetermined place has been necessary, and in both of the former and latter examples, as sheets are supported on the bins, the entire bin unit becomes heavier and a driving device of large capacity has become necessary to cover it from first, and this has led to a disadvantage that the increased cost and bulkiness of the device are unavoidable.

Also, in this type of device, as a countermeasure for a case where the movement of the frame is blocked by the extraneous force of an obstruction or the like, a ratchet plate has been provided on a drive motor portion so that the destruction of the machine is avoided with the aid of the idle revolution of the motor, while this has led to complication and increased cost of the mechanism.

SUMMARY OF THE INVENTION

The present invention has been made in view of the above-noted disadvantages peculiar to the prior art and an object thereof is to provide a novel sheet sorting device.

Another object of the present invention is to provide a sheet sorting device in which upward and downward movement of a bin unit can be accomplished smoothly.

Still another object of the present invention is to provide a sheet sorting device in which the load of the bin unit during its upward and downward movement can be reduced.

That is, according to the construction of the present invention, at least two engaging portions are used for the movement of the bin group in the sheet sorting device, whereby different engaging portions can be used in accordance with the purpose of the movement of each bin to thereby smooth the movement of each bin.

More particularly, according to the construction of a sheet sorting device using a spiral cam member having a first spiral groove of uniform slope and a second groove of discontinuous groove shape having a pin stopping member, the entire bin unit can be moved by the smooth portion of an engaging portion and only the operation of opening the frontage of the bins can be effected by another engaging portion.

Also, the load of the bin unit can be offset by a simple construction in which a spring for reducing the bin shift force is mounted, and in spite of the sheet sorting device of the present invention being a movable bin unit type sorter, a lifter (motor) of only low capacity is required, and this is useful for energy saving. Also, structurally, the force applied to a lead cam may be small and thus, the fore end of the lead cam need be less reinforced. Particularly, in a preferred embodiment of the present invention, the upper end of the lead cam is reinforced by a metal member (because all the weight of supported sheets is temporarily applied thereto), while the lower end of the lead cam should only take the weight of a bin into account and therefore need not be reinforced. Also, the load of the bin unit can be offset, whereby the load fluctuating during the upward and downward movement of the bin unit is only the weight of the supported sheets thereon and the acceleration or the like during the upward and downward movement can be minimized and the silencing effect can also be obtained.

Further, by improving the shape of the lead cam, the distance between the uppermost trunnion and the lowermost trunnion is always kept constant and therefore, the lowermost trunnion can always be opposed to the lower surface of the lead cam. As a result, a spring for urging the trunnion against the lower surface of the lead cam becomes unnecessary.

DESCRIPTION OF THE PREFERRED EMBODIMENTS

Some specific embodiments of the present invention will hereinafter be described in detail with reference to the drawings.

Figure 4:
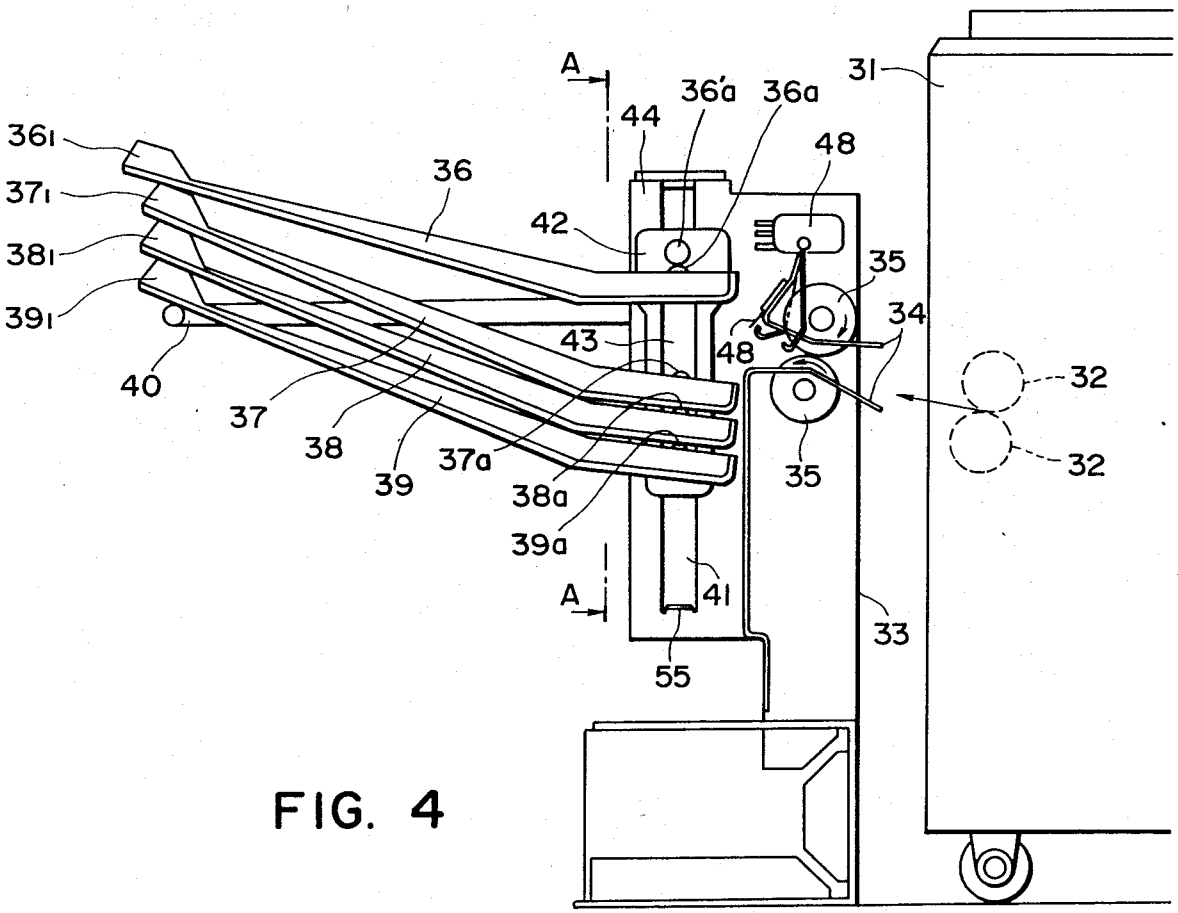
FIG. 4 is a side cross-sectional view of a sheet sorting device according to an embodiment of the present invention.

FIG. 4 is a side cross-sectional view of a sheet sorter according to an embodiment of the present invention. Sheets continuously discharged from a pair of paper discharge rollers 32 of a copying apparatus 31 are fed and received into bins 36–39 by a pair of conveyor rollers 35 through the inlet guide plate 34 of the sheet sorter 33 disposed in opposed relationship with the pair of paper discharge rollers 32. The pair of conveyor rollers 35 are rotated by a drive motor (not shown) when the bins are stopped with the space therebetween enlarged. The rear ends $36_1$, $37_1$, $38_1$ and $39_1$ of the piled-up bins 36–39 are supported by the support arm 40 of the sheet sorter body 33 and are slidably piled up.

Figure 6:
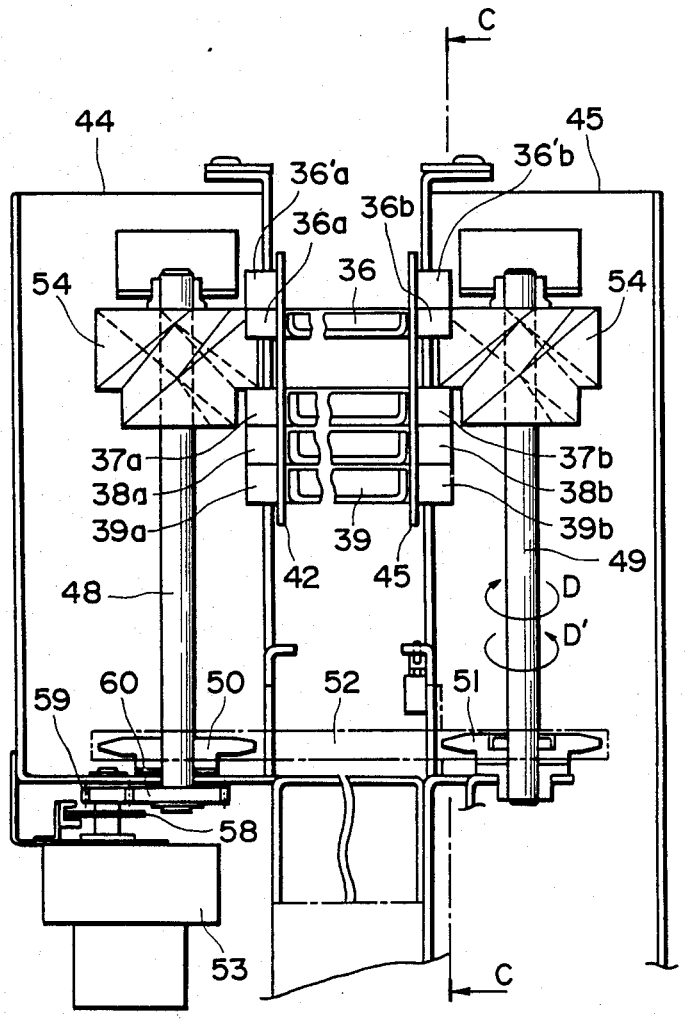
FIG. 6 is a cross-sectional view taken along line A—A of FIG. 4.

The left and right struts 44 and 45 of the sorter body 33 are disposed on the sheet receiving side of the sheet sorter (FIG. 6), and a vertically extending slot 41 is formed in the side wall of each strut. Pillar-like followers 36*a*, 36*b*, 37*a*, 37*b*, 38*a*, 38*b*, 39*a* and 39*b* provided on the left and right side surfaces of the fore ends of the bins are slidably engaged with the slots 41 (FIG. 6). The followers 36*a*, 36*b*, 37*a*, 37*b*, 38*a*, 38*b*, 39*a* and 39*b* are also engaged with support frames 42.

Figure 5:
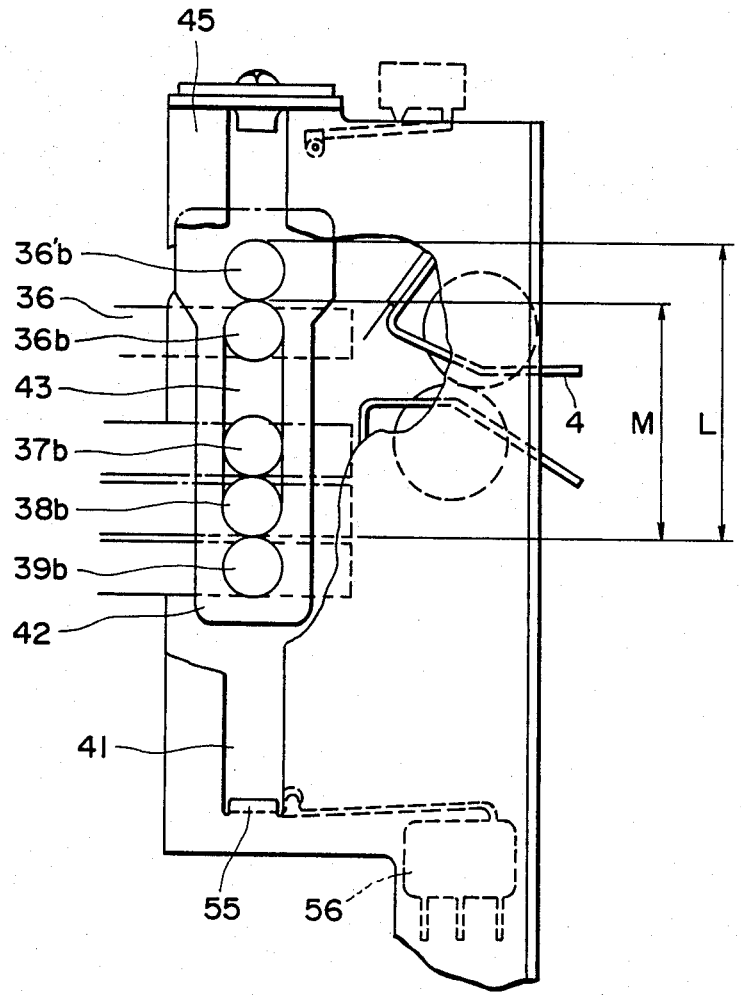
FIG. 5 is a partly broken-away cross-sectional view taken along line C—C of FIG. 6 and showing the engagement between a support frame and each follower.

FIG. 5 is a side view showing the state of engagement between one support frame 42 and each follower. A slot 43 like the slot 41 is formed in the support frame 42, and the support frame 42 is vertically slidable along the slot 41. A locating pin 36'*b* supporting the load of the bin group is engaged with the upper portion of the support frame 42 and accordingly, in the present embodiment, the support frame 42 is moved up and down by vertical movement of the locating pin 36'*b*. The followers 36*a*, 36*b*, 37*a*, 37*b*, 38*a*, 38*b* at the left and right of pins 36, 37, 38 are engaged for vertical movement in the slots 43 of the left and right support frame 42. In the present embodiment, the bin 39 is fixed to the support frames 42, but the left and right followers 39*a* and 39*b* of the bin 39 may be made vertically movable in the slots 43 of the left and right support frame 42.

FIG. 6 is a cross-sectional view as seen from the rear ends of the bins and taken along line A—A of FIG. 4. A pair of grooved spiral cams 54 each formed with a first spiral groove 54' (FIGS. 7 and 8) having a uniform slope and a second spiral groove 54'' (FIGS. 7 and 8) for enlarging the space between the bins are provided on the left and right struts 44 and 45 and are fitted to and supported by the upper portions of vertical rotary shafts 48 and 49. Sprockets 50 and 51 are provided on the lower portions of the rotary shafts 48 and 49 and transmit the rotational force of a motor 53 to the pair of spiral cams 54 through a chain 52 and gears 59, 60. The motor 53 is revolvable in forward and reverse directions and in the ensuing description, the case where it rotates the rotary shaft 49 in a direction D (the case where the bins are moved up) is called the forward revolution.

Figure 7:
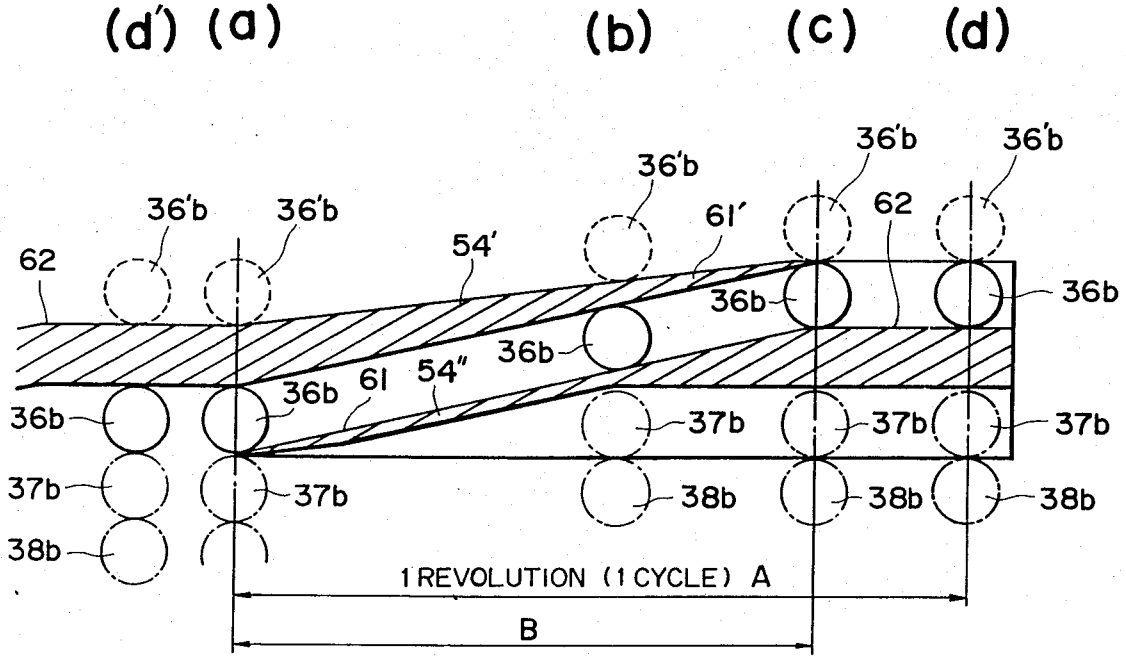
FIG. 7 is a developed view of the outer periphery of a spiral cam showing the engagement thereof with followers.
Figure 8:
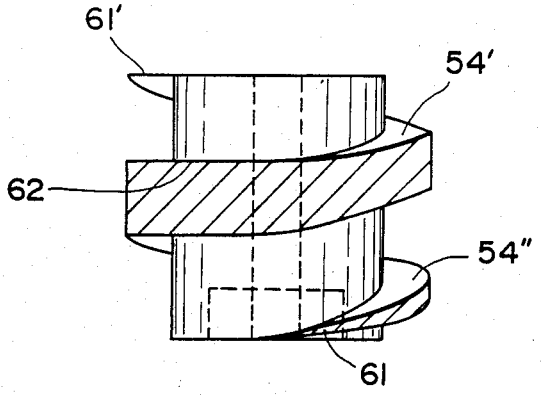
FIG. 8 is a detailed view of the spiral cam.

FIGS. 7 and 8 are developed views of the outer periphery of the spiral cam 54 according to the present invention. In FIG. 7, the stroke (d')—(d) is the locus of one revolution of the spiral cam 54. In the spiral cam 54 of the present embodiment, the pitch thereof is determined so that the followers 36*a*, 36*b*, 37*a*, 37*b*, 38*a*, 38*b*,

SHEET SORTING DEVICE

BACKGROUND OF THE INVENTION

1. Field of the Invention

This invention relates to a sheet sorting device (hereinafter referred to as the sorter) used for distribution, accumulation, etc. of sheet-like members (hereinafter simply referred to as sheets) carried out from a machine such as a copying machine, a printing machine, a recording machine or other machine (hereinafter referred to as an image forming apparatus) provided with a mechanism for conveying sheet-like members (including various sheet-like members such as copy sheets, printing sheets and recording sheets).

2. Description of the Related Art

Figure 1:
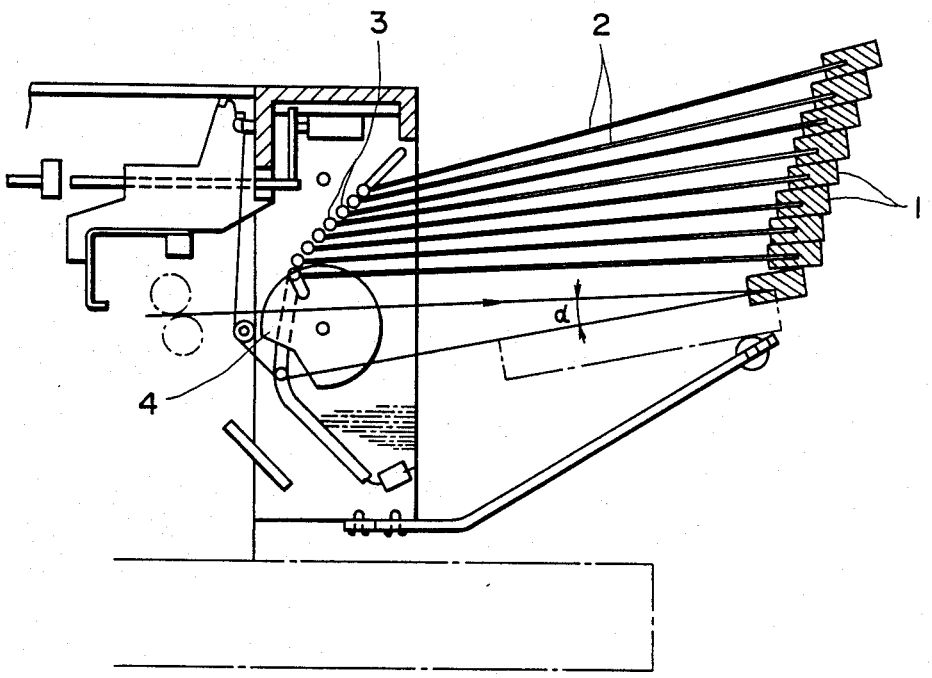
FIG. 1 PRIOR ART
FIGS. 1 to 3 are cross-sectional views showing some examples of the prior art.

The device of this type (the details of which are described in Japanese Patent Application Laid-Open No. 78770/1981) has heretofore been of a construction as shown in FIG. 1 of the accompanying drawings wherein the rear ends 1 of bins 2 are held and only the fore ends of the bins are successively moved upwardly or downwardly by the engagement between engaging members 3 at the fore ends of the bins 2 and a Geneva stop 4 or a spiral cam comprising a single groove. In such a construction, if the angle of inclination of the bins with respect to the direction of sheet conveyance is $\alpha$, the angle $\alpha$ differs from bin to bin, and this has led to a disadvantage that the sheet supporting property differs between the bins.

Figure 2:
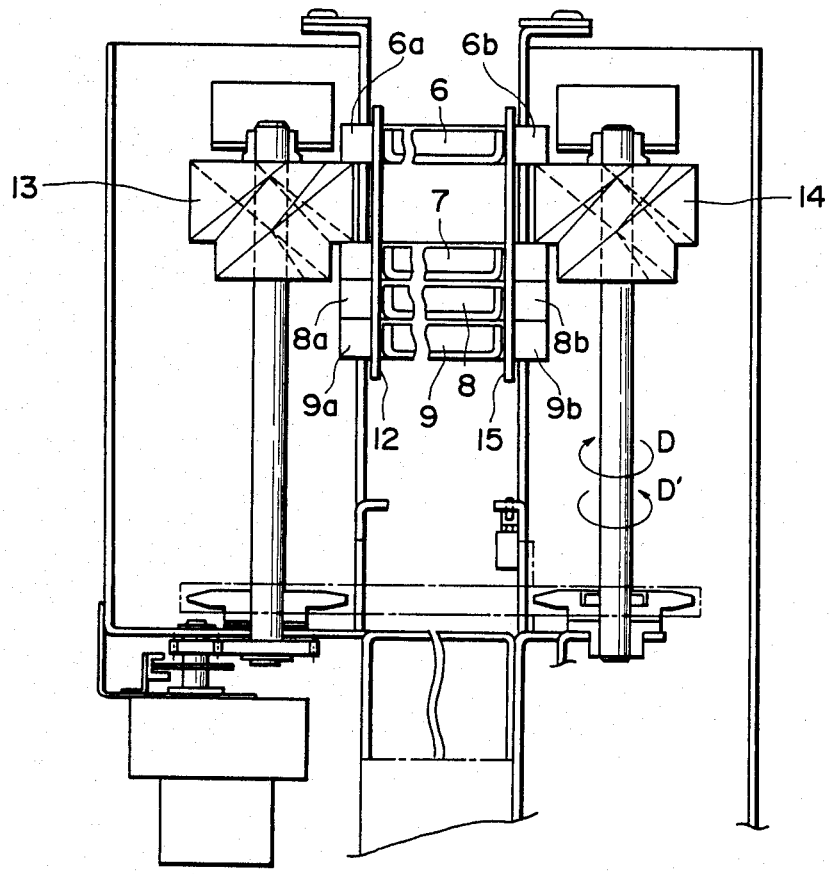
FIG. 2 PRIOR ART

As a method of the eliminating this disadvantage (that is, making the angle of inclination $\alpha$ of the bins constant), there is a method of vertically moving the bins as a unit and enlarging the spacing between the bins at the sheet carry-out port while successively moving the bins from one side to the other side. For example, as shown in FIG. 2 of the accompanying drawings, the spacing of engaging members 6*a*, 6*b*, provided on the bin 6, in the direction of movement (the spacing between 6*a*–9*a* and between 6*b*–9*b*) is controlled by support frame members 12 and 15, and an engaging member (not shown) provided on the rear end of the bin is also held by the support frame member 12 and therefore, a spiral cam comprising a spiral groove engages the engaging members (e.g. 6*a*, 6*b*) at the fore end of the bin, whereby the support frame member 12 itself is moved up and down and thus, the bin group is moved up and down as a unit. In such construction, the aforementioned disadvantage of the non-uniform supporting property of the bins is eliminated, but in the case of a high-speed sorter, when the bin tray group is to be moved upwardly or downwardly, a difficulty is caused when moving the bin tray group of heavy weight intermittently and rapidly, for example, the mechanical abrasion or damage by vibration, noise, shock, etc. Considering, for example, a case where all bins are being moved up in FIG. 2, the engaging members 9*a* and 9*b* of the bin 9 support all the load of the bin group, and the load of the bin group shifts to the engaging members 8*a* and 8*b* of the bins 8 when the bin 9 moves downwardly. Such shift of all the load takes place intermittently, whereby great noise or vibration occurs and expedites the mechanical abrasion, which in turn shortens the life of the device.

Figure 3:
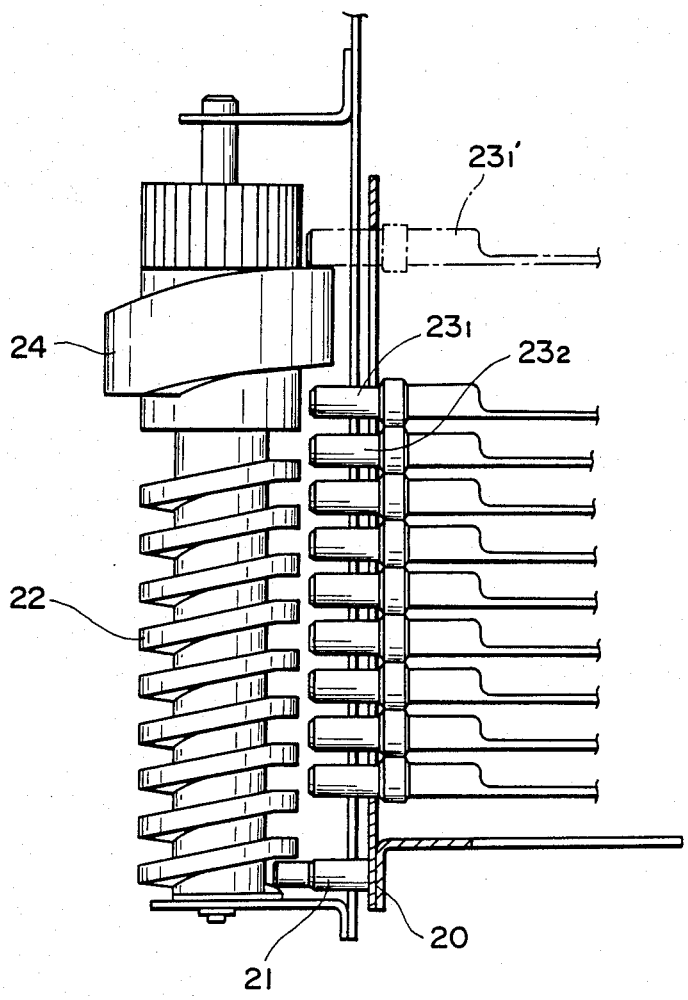
FIG. 3 PRIOR ART

Further, as a method for eliminating such a disadvantage, there is known a method of dividing moving means for the bin group and means for enlarging the spacing between the bins at the sheet carry-out port and making them discrete from each other. For example, as shown in FIG. 3 of the accompanying drawings, a pin 21 for supporting the load of the bin group is provided on a bin frame 20 and this pin 21 is brought into engagement with a lead cam shaft 22 having the shape of a spiral groove to thereby effect continuous upward and downward movement of the bin group as a unit. Also, at the sheet carry-out port, for example, a bin 23, is moved to a position 23, by a spiral cam 24 comprising a groove to thereby enlarge the spacing between the bin $23_1$ and $23_2$. With such construction, the aforementioned disadvantage of the non-uniform sheet supporting property of the bins and the noise can be eliminated. However, again in this construction, the presence of the lead cam shaft 22 and the engaging pin 21 and the difference in shape between the grooves of the spiral cam 24 and the lead cam shaft cause a phase difference in the direction of height and therefore, a mechanism for alleviating this is necessary and moreover, two large extra lead cam shafts 22 become necessary, thus making the mechanism complicated and bulky, and also there are four locations of engagement with the lead cam shafts, which means a disadvantage that the assemblage and serviceability of the device are remarkably hampered.

Also, in a movable bin type bin shifting device, a chain or wire has been fixed to the ends of a bin unit comprising a plurality of bins and a bin support plate for supporting the bins and the chain or wire has been moved by a discrete driving device to move the bin unit up or down. As another method, a pin fixed to the ends of the bin unit has been operatively associated with a rotatable lead screw and the lead screw has been rotatably controlled to thereby moved the bin unit or down. Thus, in the former example, a brake device for moving the bin unit up or down to a predetermined place and fixing it at the predetermined place has been necessary, and in both of the former and latter examples, as sheets are supported on the bins, the entire bin unit becomes heavier and a driving device of large capacity has become necessary to cover it from first, and this has led to a disadvantage that the increased cost and bulkiness of the device are unavoidable.

Also, in this type of device, as a countermeasure for a case where the movement of the frame is blocked by the extraneous force of an obstruction or the like, a ratchet plate has been provided on a drive motor portion so that the destruction of the machine is avoided with the aid of the idle revolution of the motor, while this has led to complication and increased cost of the mechanism.

SUMMARY OF THE INVENTION

The present invention has been made in view of the above-noted disadvantages peculiar to the prior art and an object thereof is to provide a novel sheet sorting device.

Another object of the present invention is to provide a sheet sorting device in which upward and downward movement of a bin unit can be accomplished smoothly.

Still another object of the present invention is to provide a sheet sorting device in which the load of the bin unit during its upward and downward movement can be reduced.

That is, according to the construction of the present invention, at least two engaging portions are used for the movement of the bin group in the sheet sorting device, whereby different engaging portions can be used in accordance with the purpose of the movement of each bin to thereby smooth the movement of each bin.

More particularly, according to the construction of a sheet sorting device using a spiral cam member having a first spiral groove of uniform slope and a second groove of discontinuous groove shape having a pin stopping member, the entire bin unit can be moved by the smooth portion of an engaging portion and only the operation of opening the frontage of the bins can be effected by another engaging portion.

Also, the load of the bin unit can be offset by a simple construction in which a spring for reducing the bin shift force is mounted, and in spite of the sheet sorting device of the present invention being a movable bin unit type sorter, a lifter (motor) of only low capacity is required, and this is useful for energy saving. Also, structurally, the force applied to a lead cam may be small and thus, the fore end of the lead cam need be less reinforced. Particularly, in a preferred embodiment of the present invention, the upper end of the lead cam is reinforced by a metal member (because all the weight of supported sheets is temporarily applied thereto), while the lower end of the lead cam should only take the weight of a bin into account and therefore need not be reinforced. Also, the load of the bin unit can be offset, whereby the load fluctuating during the upward and downward movement of the bin unit is only the weight of the supported sheets thereon and the acceleration or the like during the upward and downward movement can be minimized and the silencing effect can also be obtained.

Further, by improving the shape of the lead cam, the distance between the uppermost trunnion and the lowermost trunnion is always kept constant and therefore, the lowermost trunnion can always be opposed to the lower surface of the lead cam. As a result, a spring for urging the trunnion against the lower surface of the lead cam becomes unnecessary.

BRIEF DESCRIPTION OF THE DRAWINGS

FIGS. 1 to 3 are cross-sectional views showing some examples of the prior art.

FIG. 4 is a side cross-sectional view of a sheet sorting device according to an embodiment of the present invention.

FIG. 5 is a partly broken-away cross-sectional view taken along line C—C of FIG. 6 and showing the engagement between a support frame and each follower.

FIG. 6 is a cross-sectional view taken along line A—A of FIG. 4.

FIG. 7 is a developed view of the outer periphery of a spiral cam showing the engagement thereof with followers.

FIG. 8 is a detailed view of the spiral cam.

Figure 9:
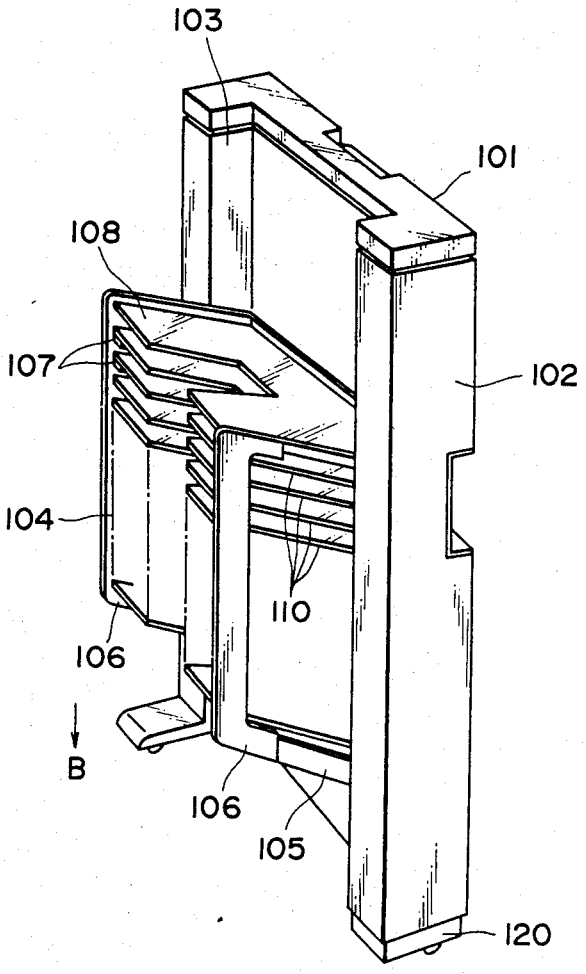
FIG. 9 is a perspective view of a sorter according to another embodiment of the present invention.

FIG. 9 is a perspective view of a sorter according to another embodiment of the present invention.

Figure 10:
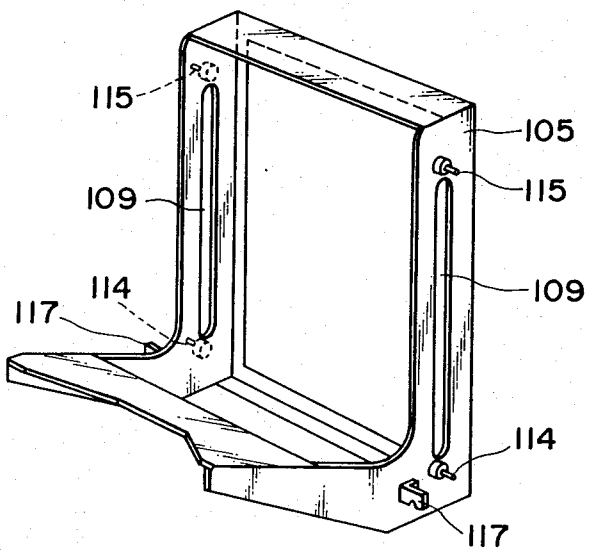
FIG. 10 is a perspective view of a bin support plate.

FIG. 10 is a perspective view of a bin support plate.

Figure 11:
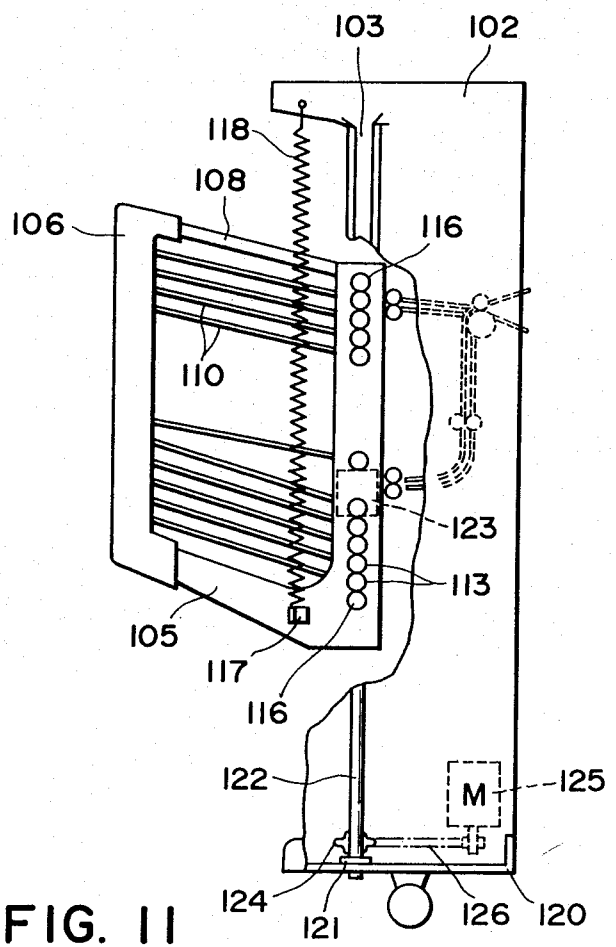
FIG. 11 is a cross-sectional view of portions of the sorter.

FIG. 11 is a cross-sectional view of portions of the sorter.

Figure 12:
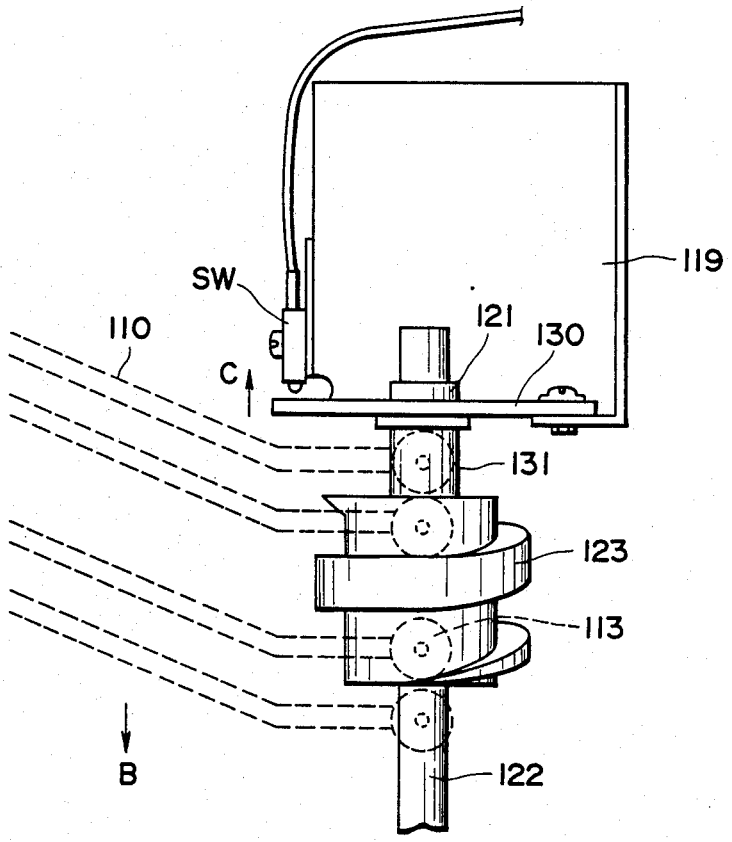
FIG. 12 is a detailed view of a lead cam portion.

FIG. 12 is a detailed view of a lead cam portion.

Figure 13:
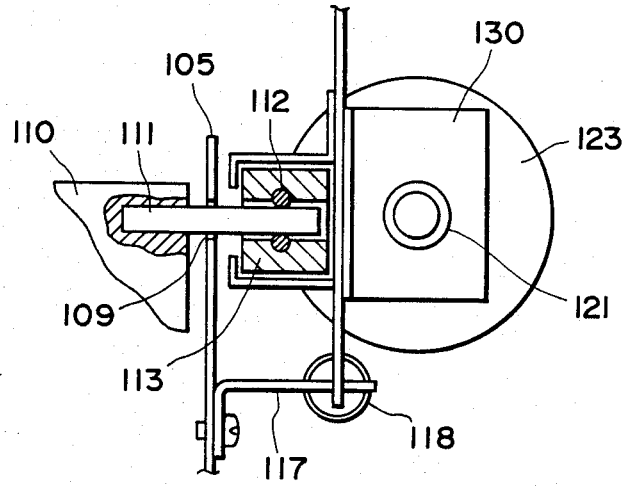
FIG. 13 is a top plan view of portions of the lead cam.

FIG. 13 is a top plan view of portions of the lead cam.

Figure 14:
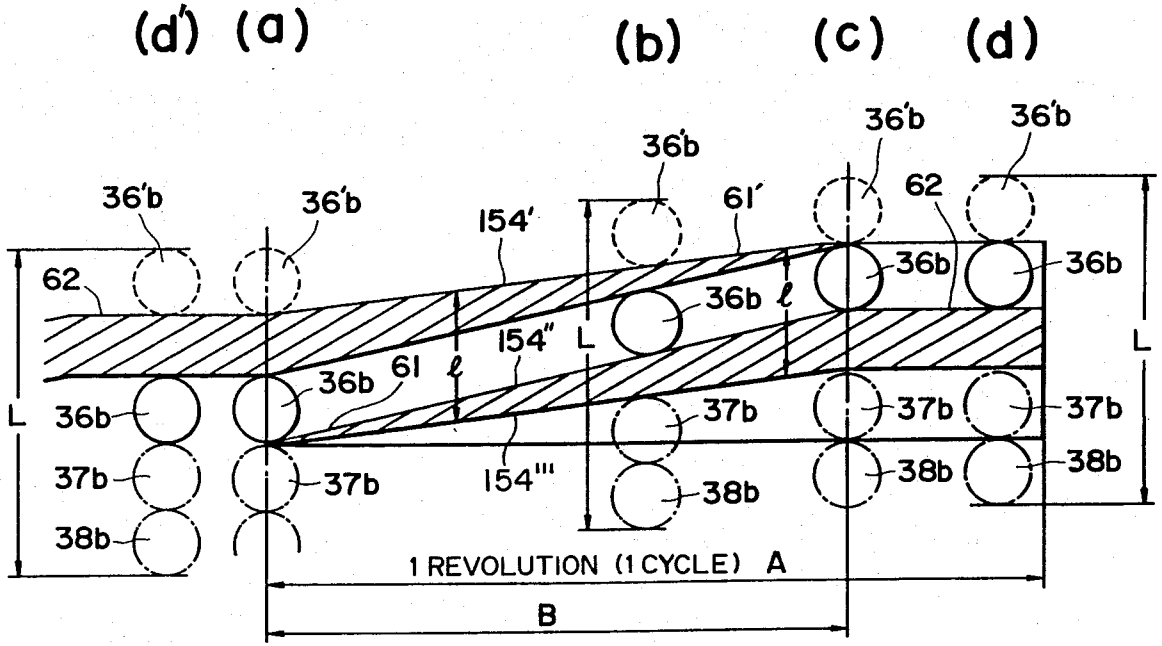
FIG. 14 is a developed view of the outer periphery of a modification of the FIG. 7 arrangement showing the engagement between a spiral cam and followers.

FIG. 14 is a developed view of the outer periphery of a modification of the FIG. 7 arrangement showing the engagement between a spiral cam and followers.

DESCRIPTION OF THE PREFERRED EMBODIMENTS

Some specific embodiments of the present invention will hereinafter be described in detail with reference to the drawings.

FIG. 4 is a side cross-sectional view of a sheet sorter according to an embodiment of the present invention. Sheets continuously discharged from a pair of paper discharge rollers 32 of a copying apparatus 31 are fed and received into bins 36–39 by a pair of conveyor rollers 35 through the inlet guide plate 34 of the sheet sorter 33 disposed in opposed relationship with the pair of paper discharge rollers 32. The pair of conveyor rollers 35 are rotated by a drive motor (not shown) when the bins are stopped with the space therebetween enlarged. The rear ends $\mathbf{36}_1$, $\mathbf{37}_1$, $\mathbf{38}_1$ and $\mathbf{39}_1$ of the piled-up bins 36–39 are supported by the support arm 40 of the sheet sorter body 33 and are slidably piled up.

The left and right struts 44 and 45 of the sorter body 33 are disposed on the sheet receiving side of the sheet sorter (FIG. 6), and a vertically extending slot 41 is formed in the side wall of each strut. Pillar-like followers 36*a*, 36*b*, 37*a*, 37*b*, 38*a*, 38*b*, 39*a* and 39*b* provided on the left and right side surfaces of the fore ends of the bins are slidably engaged with the slots 41 (FIG. 6). The followers 36*a*, 36*b*, 37*a*, 37*b*, 38*a*, 38*b*, 39*a* and 39*b* are also engaged with support frames 42.

FIG. 5 is a side view showing the state of engagement between one support frame 42 and each follower. A slot 43 like the slot 41 is formed in the support frame 42, and the support frame 42 is vertically slidable along the slot 41. A locating pin 36'*b* supporting the load of the bin group is engaged with the upper portion of the support frame 42 and accordingly, in the present embodiment, the support frame 42 is moved up and down by vertical movement of the locating pin 36'*b*. The followers 36*a*, 36*b*, 37*a*, 37*b*, 38*a*, 38*b* at the left and right of pins 36, 37, 38 are engaged for vertical movement in the slots 43 of the left and right support frame 42. In the present embodiment, the bin 39 is fixed to the support frames 42, but the left and right followers 39*a* and 39*b* of the bin 39 may be made vertically movable in the slots 43 of the left and right support frame 42.

FIG. 6 is a cross-sectional view as seen from the rear ends of the bins and taken along line A—A of FIG. 4. A pair of grooved spiral cams 54 each formed with a first spiral groove 54' (FIGS. 7 and 8) having a uniform slope and a second spiral groove 54'' (FIGS. 7 and 8) for enlarging the space between the bins are provided on the left and right struts 44 and 45 and are fitted to and supported by the upper portions of vertical rotary shafts 48 and 49. Sprockets 50 and 51 are provided on the lower portions of the rotary shafts 48 and 49 and transmit the rotational force of a motor 53 to the pair of spiral cams 54 through a chain 52 and gears 59, 60. The motor 53 is revolvable in forward and reverse directions and in the ensuing description, the case where it rotates the rotary shaft 49 in a direction D (the case where the bins are moved up) is called the forward revolution.

FIGS. 7 and 8 are developed views of the outer periphery of the spiral cam 54 according to the present invention. In FIG. 7, the stroke (d')—(d) is the locus of one revolution of the spiral cam 54. In the spiral cam 54 of the present embodiment, the pitch thereof is determined so that the followers 36*a*, 36*b*, 37*a*, 37*b*, 38*a*, 38*b*, Actually, in the sorting mode, the bin unit 104 moves up while sheets are placed onto the successive bins from the uppermost one by a sheet discharge signal. Subsequently, in the reverse sorting mode, the bin unit 104 moves down while sheets are placed onto the successive bins by a sheet discharge signal.

Such operation is repeated, and the load applied to the lead cam shaft 122 and lead cam 123 is only equal to the weight of the sheets placed on the bins.

In the above-described embodiment, the tension spring 118 is directly secured to the metal member 117 of the bin support plate 105 and the side plate 102 of the sorter body 101, but alternatively, the bin support plate 105 may be suspended by a wire or the like and a torsion coil spring or a helical spring may be caused to act on the other end of the wire, thereby achieving effective utilization of the space.

Also, in the movable bin type sorter according to the present embodiment of the present invention, when the bin moving portion is held by an extraneous force during its downward (or upward) movement, the movement can be stopped by a safety device utilizing the extraneous force. This safety device will hereinafter be described.

FIG. 12 is a detailed view of the lead cam shaft portion. The lead cam shaft 122 and the lead cam 123 are supported by a cam shaft holder 119.

There is a plate spring portion 130 in the cam shaft holder 119, and a bearing 121 is in engagement therewith.

In FIG. 9, when during the movement of the bin frame 105 in the direction B, there is present an obstruction or the like below the bin frame and the movement is hindered thereby, the various portions of FIG. 12 operate in the following manner.

The force imparted from the obstruction is transmitted to the lead cam 123 from the bin frame 105→the bins 110→the cam followers 113 and moves the lead cam 123 upwardly. That is, the lead cam 123 is moved upwardly by the downward movement of the cam followers 113 being inhibited. This force is transmitted to the plate spring portion 130 through a spacer 131 and the bearing 121 to displace the fore end of the plate spring portion 130 (in the direction of arrow C). By the amount of this displacement, a limit switch SW held on the cam shaft holder 119 is operated to stop the motor 125. Upon stoppage of the motor 125, the bin frame 105 of FIG. 9 stops its movement in the direction B, thereby preventing the destruction of the machine.

As an alternative embodiment, detection of the displacement may be effected by a photosensor instead of the limit switch SW, and the present embodiment adopts the means for detecting the amount of displacement of the plate spring 130 of the cam shaft holder 119, but instead may adopt means for directly detecting the amount of upward movement of the lead cam. Also, if the limit switch SW is provided below the plate spring, any abnormality during the upward movement may be detected.

As described above, during the downward or upward movement of the bin moving portion of the movable bin type sorter, the extraneous force which hinders it can be utilized to prevent the destruction of the machine by a simple construction.

Reference is now had to FIG. 14 to describe a modification of the lead cam 54 shown in FIG. 7.

A feature of the lead cam 154 shown in FIG. 14 is that the cross-sectional shapes of the first groove 154' and the second groove 154'' are identical in the opposite direction and the height l of the cam measured when cut at any position in a vertical direction is constant.

In the other points, the construction shown in FIG. 14 is the same as the construction shown in FIG. 7. Again in the construction of FIG. 14, when the cam 154 rotates, the followers 36*a*, 36*b*, 37*a*, 37*b*, 38*a*, 38*b*, 39*a*, 39*b* move up and down. The details of it shown in FIG. 7.

According to the feature of the construction of FIG. 14, when the followers are moved along the lead by revolution of the cam, the distance L between the lowermost follower and the uppermost pin is always constant at any point of time, Accordingly, as shown in FIG. 5, the distance M between the lower end surface of the pin 36 and the lower end surface of the slot 43 can be made minimum and thus, there will occur no play when the followers are assembled therebetween.

As a result, when the followers are moved up by revolution of the cam and the support frame 42 is moved up through the pin 36'*b*, the follower 38*b* is pushed up by the lower end surface of the slot 43. Then, the follower lying just beneath the cam 154 is urged against or brought close to the lower end surface 154 of the cam 154. Accordingly, even if the follower is not urged against the lower end surface of the cam 154 by spring means, the follower will smoothly come into engagement with the lead of the cam 154 by revolution of the cam 154 and move up.

According to the above-described feature of the cam, the follower is not urged by the spring and therefore, the engagement between the cam and the follower is accomplished smoothly and the shock is small and thus, noise or the like does not occur. Also, since the load is light, the electric power consumed is small. Further, since the engagement between the follower and the lower end surface of the cam takes place continuously, there will not happen the accident that the follower collides against the lower end surface of the cam. That is, if said distance M is made a little greater and a play is provided and spring pressure is not applied to the follower, the lower end surface of the cam and the follower will be spaced apart from each other by an amount corresponding to this play at a certain point of time, whereafter the follower will suddenly bear against the lower end surface of the cam, thereby producing a sound. According to the present embodiment, there is no such play and therefore such a sound is never produced.

We claim:

1. A sheet sorting device comprising:

a plurality of bin trays provided in a multiple stage;

a plurality of cam followers, one cam follower provided on the sheet carry-in side of each of said bin trays to maintain a spacing between said plurality of bin trays to prevent them from abutting each other;

spiral cam means having a second sloping lead portion for engaging a first one of said cam followers to enlarge the spacing between said bin trays on the sheet carry-in side thereof and moving said first cam follower upwardly, said spiral cam means also having a first lead portion sloping in the same direction as said second sloping lead portion and engageable with a second cam follower overlying said first cam follower to thereby move said second cam follower upwardly; and force transmitting means for transmitting the upward movement force of said second cam follower by said first lead portion to other cam followers underlying said first cam follower, so that said other cam followers are raised to be engaged with said spiral cam means.

2. A sheet sorting device according to claim 1, wherein said force transmitting means is a frame vertically movably supporting a fore end of said bin trays.

3. A sheet sorting device according to claim 2, wherein an uppermost cam follower is always engaged with said frame.

4. A sheet sorting device according to claim 1, wherein a height difference between both ends of said first sloping lead portion is equal to a diameter of said first cam follower.

5. A sheet sorting device comprising:

a plurality of bin trays provided in a multiple stage;

a plurality of cam followers, one cam follower provided on the sheet carry-in side of each of said bin trays to maintain a spacing between said plurality of bin trays from abutting each other;

spiral cam means having a sloping lead portion for engaging a first one of said cam followers to enlarge the spacing between said bin trays on the sheet carry-in side thereof and moving said first cam follower upwardly, a first engaging portion for engaging a cam follower overlying said first cam follower, and a second engaging portion for engaging a cam follower underlying said first cam follower, said first and second engaging portions being sloped in the same direction as said sloping lead portion, said spiral cam means being capable of keeping the spacing between said overlying cam follower and said underlying cam follower substantially constant in any revolved state; and force transmitting means for transmitting the upward movement force of said overlying cam follower to said underlying cam follower, so that other cam followers are raised to be engaged with spiral cam means.

6. A sheet sorting device according to claim 5, wherein said first engaging portion is a lead portion for engaging the overlying cam follower and moving the same.

7. A sheet sorting device according to claim 5, wherein said force transmitting means is a vertically movable frame vertically movably supporting a fore end of said bin trays.

8. A sheet sorting device according to claim 7, wherein a lowermost and an uppermost cam follower are always engaged with said frame.

9. A sheet sorting device according to claim 8, wherein the uppermost one of the cam followers underlying said spiral cam means is always substantially engaged with said second engaging portion.

10. A sheet sorting device according to claim 5, wherein the distance between an uppermost cam follower and a lowermost cam follower is always substantially constant.

11. A sheet sorting device according to claim 5, wherein all the weight of the cam followers underlying said second engaging portion is applied to the cam follower engaged with said first engaging portion through said force transmitting means.

12. A sheet sorting device according to claim 5, wherein a height difference between both ends of said first engaging portion is equal to a diameter of said first engaging portion.

* * * * *

UNITED STATES PATENT AND TRADEMARK OFFICE

CERTIFICATE OF CORRECTION

PATENT NO. : 4,854,571 Sheet 1 of 2

DATED : August 8, 1989

INVENTOR(S) : TADAYUKI KITAJIMA, ET AL.

It is certified that error appears in the above-identified patent and that said Letters Patent is hereby corrected as shown below:

COLUMN 2, line 7, "23" should read --$23_1$--;

line 8, "23" should read --$23_1$'--;

line 33, "moved" should read --move--; same line, "or" should be deleted.

COLUMN 5, line 11, "he" should read --the--;

line 19, "state (d)" should read --state (d),--;

line 57, "the" should be deleted. (first occurrence)

COLUMN 6, line 26, "bin-" should read --bins--;

line 27, "s-1) times should read -- -1)times--.

COLUMN 7, line 4, "denote" should read --denotes--;

line 14, "slides" should read --sliders--;

line 27, "113" should read --111--;

line 28, "shock absorbing" should read --shock-absorbing--.

COLUMN 8, line 51, "counter-clockwise" should read --counterclockwise--;

line 58, "moved" should read --moves--.

UNITED STATES PATENT AND TRADEMARK OFFICE

CERTIFICATE OF CORRECTION

PATENT NO. : 4,854,571 Sheet 2 of 2

DATED : August 8, 1989

INVENTOR(S) : TADAYUKI KITAJIMA, ET AL.

It is certified that error appears in the above-identified patent and that said Letters Patent is hereby corrected as shown below:

COLUMN 10, line 8, "shown" should read --are shown--;

line 14, "time," should read --time.--;

line 24, "154" should read --154'''--.

COLUMN 11, line 23, "trays from" should read --trays to prevent them from--.

Signed and Sealed this

Twenty-sixth Day of June, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,854,571

DATED : Aug. 8, 1989

INVENTOR(S) : Tadayuki Kitajima, et al.

It is certified that error appears in the above-identified patent and that said Letters Patent is hereby corrected as shown below:

On the title page, item [75], in the Inventors, delete "Kazuhiro Matsuo; Toshiaki Murayama, both of Tokyo,".

Signed and Sealed this

Thirtieth Day of April, 1991

*Attest:*

*Attesting Officer*

HARRY F. MANBECK, JR.

*Commissioner of Patents and Trademarks*